US010654048B2

(12) United States Patent
Ramos

(10) Patent No.: US 10,654,048 B2
(45) Date of Patent: May 19, 2020

(54) RECOVERY OF MOLYBDENUM USING SODIUM METABISULFITE AND A THIOCARBONATE DEPRESSANT

(71) Applicant: Chevron Phillips Chemical Company LP, The Woodlands, TX (US)

(72) Inventor: Benigno Ramos, Tucson, AZ (US)

(73) Assignee: Chevron Phillips Chemical Company LP, The Woodlands, TX (US)

( * ) Notice: Subject to any disclaimer, the term of this patent is extended or adjusted under 35 U.S.C. 154(b) by 281 days.

(21) Appl. No.: 15/908,992

(22) Filed: Mar. 1, 2018

(65) Prior Publication Data

US 2018/0257089 A1 Sep. 13, 2018

Related U.S. Application Data

(60) Provisional application No. 62/469,067, filed on Mar. 9, 2017.

(51) Int. Cl.

| | |
|---|---|
| ***B03D 1/002*** | (2006.01) |
| ***B03D 1/012*** | (2006.01) |
| ***B03D 1/02*** | (2006.01) |
| ***B03D 1/06*** | (2006.01) |
| ***B03D 1/018*** | (2006.01) |

(52) U.S. Cl.

CPC ..... *B03D 1/012* (2013.01); *B03D 1/002* (2013.01); *B03D 1/018* (2013.01); *B03D 1/02* (2013.01); *B03D 1/06* (2013.01); *B03D 2201/02* (2013.01); *B03D 2201/06* (2013.01); *B03D 2203/02* (2013.01)

(58) Field of Classification Search

CPC ..... B03D 1/012; B03D 1/002; B03D 1/018; B03D 2203/02; B03D 2201/02; B03D 2201/06

USPC ..... 209/167

See application file for complete search history.

(56) References Cited

U.S. PATENT DOCUMENTS

| | | | | |
|---|---|---|---|---|
| 2,203,739 A | | 6/1940 | Ott | |
| 3,425,551 A | | 2/1969 | Baarson et al. | |
| 4,316,797 A | | 2/1982 | Parlman | |
| 4,459,123 A | * | 7/1984 | Tatsunaka | F02B 67/06 474/101 |
| 4,459,237 A | | 7/1984 | Bresson et al. | |
| 4,514,293 A | | 4/1985 | Bresson et al. | |
| 4,533,467 A | * | 8/1985 | Kimble | B03D 1/012 209/166 |
| 4,561,971 A | | 12/1985 | Kimble et al. | |
| 4,561,984 A | | 12/1985 | Bresson et al. | |
| 4,650,568 A | * | 3/1987 | Kimble | B03D 1/012 209/167 |
| 4,678,584 A | | 7/1987 | Elfline | |
| 4,686,033 A | * | 8/1987 | Bresson | B03D 1/012 209/166 |
| 5,397,478 A | | 3/1995 | Pal et al. | |
| 5,756,622 A | | 5/1998 | Wang et al. | |
| 5,967,965 A | | 10/1999 | Vyshkina et al. | |

OTHER PUBLICATIONS

Grano et al. "Control of the Solution Interaction of Metabisulfite and Ethyl Xanthate in the Flotation of Hilton Ore of Mount Isa Mines Limited Australia", Minerals Engineering, United Kingdom, Jan. 1997, vol. 10, No. 1, pates 17-39 (Year: 1997).*

David Rocha, "Planta de Molibdeno, Metalurgia del Orfom D8, Como Sustituto del NaSH en el Circuito de Flotacion," AIMMGM, Sep. 2016, 17 pages.

"USO del Depresor Orfom D8 en Planta de Molibdeno de Concentradora I," AIMMGM, Oct. 2017, 21 pages.

Safety Data Sheet, Orfom® MCX Flotation Oil, Version 1.2, May 31, 2016, 11 pages.

Safety Data Sheet, Orfom® D8 Depressant, Version 2.9, Sep. 6, 2017, 12 pages.

Orfom® MCX Flotation Oil, Data Sheet, May 1, 2008, 1 page.

* cited by examiner

*Primary Examiner* — Thomas M Lithgow

(74) *Attorney, Agent, or Firm* — Merchant & Gould P.C.

(57) ABSTRACT

The present invention discloses mining collector compositions containing sodium metabisulfite and a thiocarbonate compound. Flotation processes for recovering molybdenum from a copper-molybdenum concentrate using the collector compositions also are disclosed.

20 Claims, No Drawings

RECOVERY OF MOLYBDENUM USING SODIUM METABISULFITE AND A THIOCARBONATE DEPRESSANT

REFERENCE TO RELATED APPLICATION

This application claims the benefit of U.S. Provisional Patent Application No. 62/469,067, filed on Mar. 9, 2017, the disclosure of which is incorporated herein by reference in its entirety.

BACKGROUND OF THE INVENTION

The present invention relates generally to mining chemical collector compositions containing sodium metabisulfite and a thiocarbonate compound. These collector compositions can be used in flotation processes for separating and recovering molybdenum from a copper-molybdenum concentrate.

SUMMARY OF THE INVENTION

This summary is provided to introduce a selection of concepts in a simplified form that are further described below in the detailed description. This summary is not intended to identify required or essential features of the claimed subject matter. Nor is this summary intended to be used to limit the scope of the claimed subject matter.

Various molybdenum collector compositions and flotation compositions are disclosed herein. In one aspect, the molybdenum collector composition of this invention can comprise sodium metabisulfite and a thiocarbonate compound, while in another aspect, the molybdenum collector composition can comprise sodium metabisulfite and a trithiocarbonate compound, and in yet another aspect, the molybdenum collector composition can comprise sodium metabisulfite and disodium carboxymethyltrithiocarbonate. Optionally, such molybdenum collector compositions can further comprise other suitable collector agents and/or suitable compounds that can depress the collection of other minerals (often referred to as depressants).

Illustrative flotation compositions can contain any of the molybdenum collector compositions disclosed herein and a copper-molybdenum concentrate (also referred to as a copper-molybdenum slurry). The water-based copper-molybdenum concentrate often can contain from about 5 to about 50 wt. %, copper, from about 0.1 to about 5 wt. % molybdenum, and from about 5 to about 50 wt. % iron, where these percentages are on an elemental basis, and exclude the weight of water in the copper-molybdenum concentrate (i.e., on a dry basis).

Flotation processes for the recovery of molybdenum from the copper-molybdenum concentrate also are disclosed herein. These processes can comprise contacting any of the molybdenum collector compositions disclosed herein with any of the copper-molybdenum concentrates disclosed herein. Unexpectedly, and beneficially, the molybdenum collector compositions and related flotation processes have excellent molybdenum recovery rates at low dosage levels, and with low recovery rates of iron and copper from the concentrate. As would be recognized by those of skill in the art, in order to achieve excellent molybdenum recovery, it can be necessary to reduce the recovery of other minerals, such as iron and copper. The recovery of other minerals can be reduced by adding compounds that can function as depressants to the collector composition.

Both the foregoing summary and the following detailed description provide examples and are explanatory only. Accordingly, the foregoing summary and the following detailed description should not be considered to be restrictive. Further, features or variations can be provided in addition to those set forth herein. For example, certain aspects can be directed to various feature combinations and sub-combinations described in the detailed description.

DEFINITIONS

To define more clearly the terms used herein, the following definitions are provided. Unless otherwise indicated, the following definitions are applicable to this disclosure. If a term is used in this disclosure but is not specifically defined herein, the definition from the IUPAC Compendium of Chemical Terminology, $2^{nd}$ Ed (1997) can be applied, as long as that definition does not conflict with any other disclosure or definition applied herein, or render indefinite or non-enabled any claim to which that definition is applied. To the extent that any definition or usage provided by any document incorporated herein by reference conflicts with the definition or usage provided herein, the definition or usage provided herein controls.

Herein, features of the subject matter can be described such that, within particular aspects, a combination of different features can be envisioned. For each and every aspect and/or feature disclosed herein, all combinations that do not detrimentally affect the designs, compositions, processes, and/or methods described herein are contemplated with or without explicit description of the particular combination. Additionally, unless explicitly recited otherwise, any aspect and/or feature disclosed herein can be combined to describe inventive designs, compositions, processes, and/or methods consistent with the present disclosure.

While compositions and methods are described herein in terms of "comprising" various components or steps, the compositions and methods can also "consist essentially of" or "consist of" the various components or steps, unless stated otherwise. For example, a molybdenum collector composition consistent with aspects of the present invention can comprise; alternatively, can consist essentially of; or alternatively, can consist of; sodium metabisulfite, a thiocarbonate compound, and another collector agent (e.g., a hydrocarbon or alkane mixture) or a depressant.

The terms "a," "an," and "the" are intended to include plural alternatives, e.g., at least one. For instance, the disclosure of "a collector agent" is meant to encompass one, or mixtures or combinations of more than one, collector agent, unless otherwise specified.

Generally, groups of elements are indicated using the numbering scheme indicated in the version of the periodic table of elements published in Chemical and Engineering News, 63(5), 27, 1985. In some instances, a group of elements can be indicated using a common name assigned to the group; for example, alkali metals for Group 1 elements, alkaline earth metals for Group 2 elements, transition metals for Group 3-12 elements, and halogens or halides for Group 17 elements.

For any particular compound or group disclosed herein, any name or structure presented is intended to encompass all structural isomers, conformational isomers, regioisomers, stereoisomers, and mixtures thereof that can arise from a particular set of substituents, unless otherwise specified. The name or structure also encompasses all enantiomers, diastereomers, and other optical isomers (if there are any), whether in enantiomeric or racemic forms, as well as mixtures of stereoisomers, as would be recognized by a skilled artisan, unless otherwise specified. For example, a general reference to hexene (or hexenes) includes all linear or branched, acyclic or cyclic, hydrocarbon compounds having six carbon atoms and 1 carbon-carbon double bond; pentane includes n-pentane, 2-methyl-butane, and 2,2-dimethylpropane; and a general reference to a butyl group includes an n-butyl group, a sec-butyl group, an iso-butyl group, and a t-butyl group.

The terms "contact product," "contacting," and the like, are used herein to describe compositions and methods wherein the components are contacted together in any order, in any manner, and for any length of time, unless otherwise specified. For example, the components can be contacted by blending or mixing. Further, unless otherwise specified, the contacting of any component can occur in the presence or absence of any other component of the compositions and methods described herein. Combining additional materials or components can be done by any suitable method. Further, the term "contact product" includes mixtures, blends, solutions, slurries, reaction products, and the like, or combinations thereof. Although "contact product" can, and often does, include reaction products, it is not required for the respective components to react with one another. Similarly, the term "contacting" is used herein to refer to materials which can be blended, mixed, slurried, dissolved, reacted, treated, or otherwise contacted in some other manner. Therefore, the term "contacting" encompasses the "reacting" of two or more components, and it also encompasses the "mixing" or "blending" of two or more components that do not react with one another.

Various numerical ranges are disclosed herein. When a range of any type is disclosed or claimed herein, the intent is to disclose or claim individually each possible number that such a range could reasonably encompass, including end points of the range as well as any sub-ranges and combinations of sub-ranges encompassed therein, unless otherwise specified. As a representative example, the present application discloses that the weight ratio of the thiocarbonate compound to sodium metabisulfite in the molybdenum collector composition often can fall within a range from about 1:5 to about 5:1 in certain aspects. By a disclosure that the weight ratio of thiocarbonate compound:sodium metabisulfite can be in a range from about 1:5 to about 5:1, the intent is to recite that the weight ratio can be any weight ratio within the range and, for example, can be equal to about 1:5, about 1:3, about 1:2, about 1:1.5, about 1:1, about 1.5:1, about 2:1, about 3:1, or about 5:1. Additionally, the weight ratio can be within any range from about 1:5 to about 5:1 (for example, the weight ratio can be in a range from about 1:2 to about 4:1), and this also includes any combination of ranges between about 1:5 and about 5:1. Likewise, all other ranges disclosed herein should be interpreted in a manner similar to this example.

The term "about" means that amounts, sizes, formulations, parameters, and other quantities and characteristics are not and need not be exact, but can be approximate including being larger or smaller, as desired, reflecting tolerances, conversion factors, rounding off, measurement errors, and the like, and other factors known to those of skill in the art. In general, an amount, size, formulation, parameter or other quantity or characteristic is "about" or "approximate" whether or not expressly stated to be such. The term "about" also encompasses amounts that differ due to different equilibrium conditions for a composition resulting from a particular initial mixture. Whether or not modified by the term "about," the claims include equivalents to the quantities. The term "about" can mean within 10% of the reported numerical value, preferably within 5% of the reported numerical value.

Although any methods and materials similar or equivalent to those described herein can be used in the practice or testing of the invention, the typical methods and materials are herein described.

All publications and patents mentioned herein are incorporated herein by reference for the purpose of describing and disclosing, for example, the constructs and methodologies that are described in the publications, which might be used in connection with the presently described invention.

DETAILED DESCRIPTION OF THE INVENTION

The present invention provides molybdenum collector compositions containing sodium metabisulfite and a thiocarbonate compound, and the use of the collector compositions in flotation processes for recovering molybdenum from a copper-molybdenum concentrate. An unexpected benefit of such compositions and processes is the high recovery rate of molybdenum. Another benefit of these compositions and processes is the low level of copper and iron recovery associated with the recovered molybdenum product. Also advantageously, these compositions and processes can selectively remove molybdenum from a copper-molybdenum concentrate in which the molybdenum is present at much lower amounts than copper, for instance, where the weight ratio of molybdenum:copper in the concentrate is less than 5:95.

Collector Compositions

Aspects of this invention are directed to molybdenum collector compositions containing sodium metabisulfite and a thiocarbonate compound. These compounds can work synergistically to both improve the molybdenum recovery and reduce the recovery of other minerals, such as copper and iron. Unexpectedly, it was found that the molybdenum collector compositions disclosed herein are very effective at removing molybdenum from a mixture of metals containing small amounts of molybdenum along with other metals present in much higher concentrations. Further, the molybdenum collector compositions disclosed herein were also found to be very selective with regard to maximizing the recovery of molybdenum, while minimizing the recovery of copper and iron from the mixture.

In one aspect, a molybdenum collector composition of this invention can comprise sodium metabisulfite and a thiocarbonate compound. Any suitable thiocarbonate compound can be used, non-limiting examples of which are disclosed in U.S. Pat. Nos. 3,425,551, 4,316,797, 4,459,237, and 4,561,971, incorporated herein by reference in their entirety. For instance, the molybdenum collector composition can comprise sodium metabisulfite and a trithiocarbonate compound. Any suitable trithiocarbonate compound can be used, and non-limiting examples of such compounds also are disclosed in the aforementioned patents. In a particular aspect of this invention, the thiocarbonate compound (or trithiocarbonate compound) can comprise disodium carboxymethyltrithiocarbonate. Thus, a molybdenum collector composition of this invention can comprise sodium metabisulfite and disodium carboxymethyltrithiocarbonate.

The relative amounts of the thiocarbonate compound and sodium metabisulfite in the molybdenum collector compositions are not particularly limited, however, the weight ratio of the thiocarbonate compound to sodium metabisulfite often can fall within a range from about 1:10 to about 10:1.

In some aspects of this invention, the weight ratio of the thiocarbonate compound to sodium metabisulfite can be in a range from about 1:10 to about 1:1, from about 1:1 to about 10:1, from about 1:5 to about 1:1, or from about 1:1 to about 5:1, while in other aspects, the weight ratio of the thiocarbonate compound to sodium metabisulfite can be in a range from about 1:5 to about 5:1, from about 1:3 to about 3:1, from about 1:2 to about 2:1, from about 1:2 to about 6:1, from about 1:1 to about 6:1, from about 2:1 to about 10:1, or from about 2:1 to about 4:1.

Consistent with aspects of this invention, the molybdenum collector composition can further comprise water, a pH control agent, or both water and a pH control agent. Illustrative pH control agents can include, but are not limited to, lime, carbonate compounds, sulfuric acid, and the like, as well as combinations thereof. Thus, the molybdenum collector composition can be an aqueous mixture, such as an aqueous solution, slurry, or emulsion.

Moreover, the molybdenum collector composition can further comprise another suitable collector agent (a second collector agent), if desired. Thus, any of the molybdenum collector compositions can further comprise a second collector agent, non-limiting examples of which can include a xanthate, a xanthic ester, a xanthogen formate, a dialkyl dithiophosphate, a thionocarbamate, an alkylthiol, an aliphatic, mixed aliphatic, or paraffinic hydrocarbon, and the like, as well as combinations thereof. For instance, a suitable hydrocarbon collector agent that can be used—in combination with sodium metabisulfite and the thiocarbonate compound—is Orfom® MCX flotation oil (a mixture of $C_{13}$-$C_{16}$ isoalkanes).

When used, the amount of the second collector agent is not particularly limited. Generally, the second collector agent can be present in the molybdenum collector composition at an amount in a range from about 0.1 to about 15 wt. %, from about 0.1 to about 10 wt. %, from about 0.5 to about 10 wt. %, from about 0.5 to about 5 wt. %, from about 1 to about 15 wt. %, from about 1 to about 10 wt. %, from about 1 to about 5 wt. %, from about 2 to about 10 wt. %, from about 2 to about 8 wt. %, or from about 2 to about 4 wt. %. These weight percentages are based on the amount of the second collector agent to the total amount of the thiocarbonate compound and sodium metabisulfite present in the molybdenum collector composition.

Copper-molybdenum concentrates also are provided herein, and such concentrates can contain water, copper, and molybdenum, and in some aspects, can additionally contain iron and silicates. Unless stated otherwise, the copper and molybdenum can be in any form, independently and for instance, copper-containing or molybdenum-containing minerals or compounds (e.g., copper sulfides, molybdenum sulfides, copper oxides, molybdenum oxides), copper or molybdenum ions, or elemental copper or molybdenum, as well as combinations thereof. The copper-molybdenum concentrate also can be referred to herein as a copper-molybdenum slurry or a copper-molybdenum mixture, and the concentrate (or slurry, or mixture) is the base material from which the molybdenum is preferentially extracted by the molybdenum collector composition, in accordance with the flotation processes described herein.

The amount of copper in the copper-molybdenum concentrate often can fall within a range from about 5 to about 50 wt. %, but is not limited thereto. In one aspect of this invention, the copper-molybdenum concentrate can contain from about 7 to about 40 wt. % copper, while in another aspect, the copper-molybdenum concentrate can contain from about 10 to about 35 wt. % copper, and in yet another aspect, the copper-molybdenum concentrate can contain from about 20 to about 40 wt. % copper. These percentages are on an elemental copper basis, and exclude the weight of water in the copper-molybdenum concentrate (i.e., on a dry basis).

Likewise, the amount of molybdenum in the copper-molybdenum concentrate is not particularly limited, although molybdenum is typically present at much lower concentrations than copper. For instance, the copper-molybdenum concentrate can contain from about 0.1 to about 5 wt. % molybdenum. Alternatively, the copper-molybdenum concentrate can contain from about 0.1 to about 3 wt. % molybdenum; alternatively, from about 0.1 to about 1 wt. % molybdenum; alternatively, from about 0.3 to about 3 wt. % molybdenum; or alternatively, from about 0.4 to about 1 wt. % molybdenum. These percentages are on an elemental molybdenum basis, and exclude the weight of water in the copper-molybdenum concentrate (i.e., on a dry basis).

The copper-molybdenum concentrate can further comprise iron (e.g., iron pyrite and chalcopyrite), and typically iron is present—in any form, e.g., iron-containing minerals or compounds, iron ions, elemental iron—at an amount in a range from about 5 to about 50 wt. % iron. In some aspects, the copper-molybdenum concentrate can contain from about 10 to about 50 wt. % iron, from about 10 to about 35 wt. % iron, or from about 20 to about 40 wt. % iron. As above, these percentages are on an elemental iron basis, and exclude the weight of water in the copper-molybdenum concentrate (i.e., on a dry basis).

In another aspect, the copper-molybdenum concentrate can further comprise a suitable frothing agent. Illustrative frothing agents can include, but are not limited to, pine oil; alcohols such as methyl isobutyl carbinol (MIBC); and polyether alcohols and other alcohol-based frothing agents, representative examples of which include NALFLOTE® 9837 and Cytec OREPREP® X-133. Combinations of more than one frothing agent can be present in the copper-molybdenum concentrate.

Additionally, the copper-molybdenum concentrate can further comprise any suitable collector agent. Non-limiting examples of suitable collector agents can include a xanthate, a xanthic ester, a dialkyl dithiophosphate, a thionocarbamate, an alkylthiol, an aliphatic or paraffinic hydrocarbon, and the like. Combinations of more than one collector agent can be present in the copper-molybdenum concentrate.

As would be recognized by those of skill in the art, the copper-molybdenum concentrate can be produced by a method comprising contacting a ground ore with a metal collector agent in a froth flotation process to recover copper and molybdenum. The ground ore is not particularly limited, although typically the ore comprises a copper-bearing ore, a molybdenum-bearing ore, an iron-bearing ore, or ores that are any combination of copper-bearing, molybdenum-bearing, and iron-bearing (e.g., a copper-bearing and molybdenum-bearing ore). Illustrative and non-limiting examples of such ores include chalcopyrite, chalcocite, molybdenite, and the like.

Flotation compositions also are provided herein, and such compositions can comprise (i) any of the molybdenum collector compositions disclosed herein, and (ii) any of the copper-molybdenum concentrates disclosed herein. The relative amounts of the molybdenum collector composition and the copper-molybdenum concentrate in the flotation composition are not particularly limited, however, the ratio of the weight of the molybdenum collector composition to weight of the copper-molybdenum concentrate generally falls within a range from about 0.05 to about 25 lb of molybdenum collector composition per ton of copper-molybdenum concentrate. For instance, the ratio of the weight of the molybdenum collector composition to the weight of the copper-molybdenum concentrate can be in a range from about 0.05 to about 15 lb, from about 0.5 to about 15 lb, from about 0.5 to about 10 lb, from about 1 to about 25 lb, from about 1 to about 10 lb, or from about 1 to about 5 lb, of molybdenum collector composition per ton of copper-molybdenum concentrate, on a dry basis.

Generally, the pH of the flotation composition can be in a range from about 6 to about 12, but is not limited thereto. In one aspect, the flotation composition has a pH in a range from about 7 to about 11, or from about 7 to about 10, while in another aspect, the pH can be in a range from about 8 to about 10, or from about 7 to about 9.

Flotation Processes

Aspects of this invention are directed to a flotation processes for the recovery of molybdenum from a copper-molybdenum concentrate. In these processes, the molybdenum can be recovered in any form, for example, a molybdenum-containing mineral or compound (e.g., molybdenum sulfide or molybdenite), a molybdenum ion, or elemental molybdenum, as well as combinations thereof. One such flotation process for the recovery of molybdenum from a copper-molybdenum concentrate can comprise contacting any suitable molybdenum collector composition (e.g., any molybdenum collector composition disclosed herein) with any suitable copper-molybdenum concentrate (e.g., any copper-molybdenum concentrate disclosed herein). Equipment and techniques for the flotation recovery of molybdenum from a copper-molybdenum concentrate are well known to those of skill in the art (e.g., aeration of the flotation composition, and recovery of molybdenum from the froth), and are illustrated representatively herein in the examples that follow. Thus, the flotation process can comprise contacting the molybdenum collector composition and the copper-molybdenum concentrate to form a flotation composition, aerating the flotation composition to form a molybdenum-containing froth, and recovering molybdenum from the molybdenum-containing froth.

The relative amounts of the molybdenum collector composition and the copper-molybdenum concentrate used in the flotation processes consistent with this invention are not particularly limited. Nonetheless, the ratio of the weight of the molybdenum collector composition to the weight of the copper-molybdenum concentrate generally falls within a range from about 0.05 to about 25 lb of molybdenum collector composition per ton of the copper-molybdenum concentrate. For instance, the molybdenum collector composition and the copper-molybdenum concentrate can be contacted at a ratio of the weight of the molybdenum collector composition to the weight of the copper-molybdenum concentrate in a range from about 0.05 to about 15 lb, from about 0.5 to about 15 lb, from about 1 to about 25 lb, from about 1 to about 10 lb, or from about 1 to about 5 lb, of molybdenum collector composition per ton of copper-molybdenum concentrate, on a dry basis.

Generally, the molybdenum collector composition and the copper-molybdenum concentrate are contacted at any suitable pH, typically in a range from about 6 to about 12, but not limited thereto. In one aspect, the pH can be in a range from about 7 to about 11, or from about 7 to about 10, while in another aspect, the pH can be in a range from about 8 to about 10, or from about 7 to about 9.

Unexpectedly, the flotation processes and molybdenum collector compositions disclosed herein provide high recovery rates of molybdenum. For example, the percent recovery of molybdenum in the flotation process can be at least about 85 wt. %, at least about 88 wt. %, or at least about 90 wt. %. More typically, the percent recovery of molybdenum in the flotation process can be at least about 91 wt. %, at least about 92 wt. %, at least about 93 wt. %, at least about 94 wt. %, or at least about 95 wt. %, and often can be up to about 97-99 wt. %. Percent recovery (wt. %) is defined as the total amount of molybdenum recovered after the flotation process (froth) divided by the total amount of molybdenum present in the copper-molybdenum concentrate prior to the flotation process.

Beneficially, the disclosed flotation processes and molybdenum collector compositions selectively remove molybdenum from the copper-molybdenum concentrate, while not recovering significant amounts of copper and iron in the froth. In one aspect, for example, the percent recovery of copper can be less than about 15 wt. %; alternatively, less than about 12 wt. %; alternatively, less than about 10 wt. %; alternatively, less than about 8 wt. %; alternatively, less than about 5 wt. %; or alternatively, less than about 4 wt. %; and often can be as low as about 1-3 wt. %. Likewise, the percent recovery of iron can be less than about 15 wt. %; alternatively, less than about 10 wt. %; alternatively, less than about 8 wt. %; alternatively, less than about 6 wt. %; alternatively, less than about 5 wt. %; or alternatively, less than about 4 wt. %; and often can be as low as about 1-3 wt. %. As above, the percent recovery (wt. %) is the total amount of copper (or iron) recovered after the flotation process (froth) divided by the total amount of copper (or iron) present in the copper-molybdenum concentrate prior to the flotation process.

The use of sodium metabisulfite in the molybdenum collector composition—which comprises sodium metabisulfite and the thiocarbonate compound—provides the unexpected benefits of increasing molybdenum recovery, while the collector composition still suppresses the recovery of copper and iron. For instance, the percent recovery of molybdenum can be greater (e.g., by at least about 2 wt. %, by at least about 3 wt. %, by at least about 4 wt. %, by at least about 5 wt. %, and often up to about 6-10 wt. %) than the percent recovery of molybdenum using the molybdenum collector composition without sodium metabisulfite, under the same flotation conditions. Additionally or alternatively, the percent recovery of copper can be less (e.g., by at least about 1 wt. %, by at least about 2 wt. %, or by at least about 3 wt. %) than the percent recovery of copper using the molybdenum collector composition without sodium metabisulfite, or within about 2 wt. %, or within about 5 wt. %, of the percent recovery of copper using the molybdenum collector composition without sodium metabisulfite, under the same flotation conditions. Additionally or alternatively, the percent recovery of iron can be less (e.g., by at least about 1 wt. %, by at least about 2 wt. %, or by at least about 3 wt. %) than the percent recovery of iron using the molybdenum collector composition without sodium metabisulfite, or within about 2 wt. %, or within about 5 wt. %, of the percent recovery of iron using the molybdenum collector composition without sodium metabisulfite, under the same flotation conditions. The same flotation conditions are meant to include the same flotation equipment and technique, as well as the same dosage level of the thiocarbonate compound.

The standard compound used to recover molybdenum from a copper-molybdenum concentrate is sodium hydrosulfide (NaSH). While not wishing to be bound by theory, it is believed that NaSH improves molybdenum recovery by depressing the recovery of copper.

However, this material is susceptible to producing $H_2S$ during flotation operations. Beneficially, the molybdenum collector compositions of this invention do not have this drawback, and quite surprisingly, can provide comparable recoveries of molybdenum (high), and copper and iron (low), to that of NaSH. For example, the percent recovery of molybdenum can be greater (e.g., by at least about 1 wt. %, by at least about 2 wt. %, or by at least about 3 wt. %) than the percent recovery of molybdenum using NaSH instead of the molybdenum collector composition, or within about 2 wt. %, or within about 5 wt. %, of the percent recovery of molybdenum using NaSH instead of the molybdenum collector composition, under the same flotation conditions. Additionally or alternatively, the percent recovery of copper can be less (e.g., by at least about 1 wt. %, by at least about 2 wt. %, or by at least about 3 wt. %) than the percent recovery of copper using NaSH instead of the molybdenum collector composition, or within about 2 wt. %, or within about 5 wt. %, of the percent recovery of copper using NaSH instead of the molybdenum collector composition, under the same flotation conditions. Additionally or alternatively, the percent recovery of iron can be less (e.g., by at least about 1 wt. %, by at least about 2 wt. %, or by at least about 3 wt. %) than the percent recovery of iron using NaSH instead of the molybdenum collector composition, or within about 2 wt. %, or within about 5 wt. %, of the percent recovery of iron using NaSH instead of the molybdenum collector composition, under the same flotation conditions. The same flotation conditions are meant to include the same flotation equipment and technique, as well as the same dosage level of the respective collector agents (amount of thiocarbonate compound plus sodium metabisulfite, versus amount of NaSH).

Moreover, the percent grade of molybdenum can be greater (e.g., by at least about 1 wt. %, by at least about 2 wt. %, or by at least about 3 wt. %) than the percent grade of molybdenum using NaSH instead of the molybdenum collector composition, or within about 2 wt. %, or within about 5 wt. %, of the percent grade of molybdenum using NaSH instead of the molybdenum collector composition, under the same flotation conditions. Additionally or alternatively, the percent grade of molybdenum can be greater (e.g., by at least about 1 wt. %, by at least about 2 wt. %, or by at least about 3 wt. %) than the percent grade of molybdenum using the molybdenum collector composition without sodium metabisulfite, or within about 2 wt. %, or within about 5 wt. %, of the percent grade of molybdenum using the molybdenum collector composition without sodium metabisulfite, under the same flotation conditions. The percent grade (wt. %) of molybdenum is the amount of molybdenum recovered after the flotation process (froth) divided by the total amount of solid sample recovered after flotation, on a dry basis.

EXAMPLES

The invention is further illustrated by the following examples, which are not to be construed in any way as imposing limitations to the scope of this invention. Various other aspects, modifications, and equivalents thereof which, after reading the description herein, may suggest themselves to one of ordinary skill in the art without departing from the spirit of the present invention or the scope of the appended claims.

Examples A1-A3

Flotation Recovery of Molybdenum

A Cu—Mo slurry was used as received from a copper-molybdenum thickener, which was produced from copper porphyry ore by a standard flotation method to recovery copper sulfides and molybdenite.

The Cu—Mo slurry contained solids with a calculated concentration (also called calculated feed or head grade) of 0.60 wt. % Mo, 27.33 wt. % Cu, and 30.94 wt. % Fe on an elemental and dry basis. The Cu was present mainly as chalcopyrite, and Mo was present mainly as molybdenite. Iron was also present in the Cu—Mo concentrate, typically as iron pyrite and part of the chalcopyrite. The Cu—Mo slurry also contained residual collector agents, frothing agents, and lime.

For Example A1, the flotation procedure for recovering Mo from the Cu—Mo slurry was as follows. Approximately 1,600 grams of the slurry (at about 30 wt. % solids) were placed in a 4 L flotation cell. The Metso Minerals flotation machine was turned on and dilute sulfuric acid (10 wt. %) was added to adjust the pH to 8.4, and the slurry was conditioned for two min at a stir rate of 1200 rpm. Added to the stirred slurry were 2,462 grams/ton of Orfom® D8 depressant (38 wt. % disodium carboxymethyltrithiocarbonate; 935 grams/ton, dry weight), 360 grams/ton of sodium metabisulfite, and 31 grams/ton of Orfom® MCX flotation oil ($C_{13}$-$C_{16}$ isoalkanes) to form a flotation mixture. The Orfom® MCX flotation oil ($C_{13}$-$C_{16}$ isoalkanes) was also used at the same nominal loading in Examples A2-A3.

After conditioning for 10 min, air was bubbled into the flotation mixture, and froth, also referred to as "concentrate," containing primarily molybdenite and chalcopyrite, and minor components of chalcocite and pyrite, was removed from the surface of the cell approximately every 15 sec. The froth was collected in a metal pan under the lip of the cell for 1 min. The air was turned off to cease formation of the froth, stirring continued, the concentrate collected in the pan was removed, and a new metal pan was put under the lip of the cell. The air was turned back on and froth was removed from the surface of the cell approximately every 15 sec for 2 min. This process was repeated at the end of this 2 min collection, after an additional 3 min, after an additional 4 min, and after an additional 5 min, resulting in 5 concentrates collected over a 15 min period. Water was added periodically to keep the level of the flotation mixture near the lip of the cell so froth could be easily removed. Care was taken to not have froth flow over the lip without raking with the paddle. The standpipe and back cell corners were washed down as needed. Depending on the frothiness of the composition, it was sometimes necessary to restrict the air at the beginning of the flotation to prevent froth from overflowing the cell on its own.

The air and stirring were turned off and the apparatus was washed to remove solids from the stirrer and shaft into the flotation cell.

The rougher concentrates collected in the pans were filtered through filter paper and dried in an oven at 75° C. overnight. The dried solids were weighed and labeled as rougher concentrates 1 through 5.

Rougher concentrates 1 through 5 were analyzed for molybdenum, copper, and iron content by digesting a sample over heat in a solution containing potassium chlorate, nitric acid, and hydrochloric acid, cooling the sample, and analyzing the sample via atomic absorption using a nitrous oxide-acetylene red flame.

The same flotation procedure was used for Example A2, except that no sodium metabisulfite was used, and 2,496 g/ton of Orfom® D8 depressant (38 wt. % disodium carboxymethyltrithiocarbonate; 948 g/ton, dry weight) were used. Likewise, the same flotation procedure was used for Example A3, except that approximately 1,800 grams of the Cu—Mo slurry (at about 30 wt. % solids) were used, nitrogen was bubbled into the slurry to create the froth, and 5,479 g/ton (calculated as dry weight) of dilute NaSH was added to achieve an ORP of −520 mV (sodium metabisulfite and Orfom® D8 depressant were not used).

Table I summarizes the percent grade and percent recoveries of Mo, Cu, and Fe for Example A1-A3. Duplicates of each flotation experiment were conducted, and the average was reported. It should be noted that the data represents only the results obtained from rougher concentrates 1-4 as described above, and does not include the Mo, Cu, and Fe recovered in rougher concentrate 5 (the sample collected after 15 min). The cumulative amount of rougher concentrates 1-4 represents the total amount of molybdenum, copper, and iron, respectively, which were recovered using the flotation process.

As shown in Table I, and unexpectedly, Example A1 had a percent recovery of molybdenum of 95.02 wt. %, significantly better than that of Example A2 (which did not use sodium metabisulfite and had a recovery of 88.35 wt. %). Moreover, Example A1 had a percent recovery of molybdenum that was comparable to Example A3, even though Example A3 used a significantly higher collector agent dosage (5479 g/ton of NaSH). Further, Example A1 was conducted at a less basic, more neutral pH. Also beneficially, the percent recoveries of copper and iron were less than 8 wt. % for Example A1, and comparable to the respective percent recoveries in Example A3. Thus, the molybdenum collector composition used in Example A1 was successful at selectively removing molybdenum from a Cu—Mo slurry (or concentrate) in which the molybdenum was present at a much lower concentration that copper.

Sodium metabisulfite was not tested alone, because this reagent is only effective in combination with Orfom® D8 depressant (when used alone, there is no significantly molybdenum recovery).

Examples B1-B5

Flotation Recovery of Molybdenum

A Cu—Mo slurry was used as received from a copper-molybdenum thickener, which was produced from copper porphyry ore by a standard flotation method to recovery copper sulfides and molybdenite.

The Cu—Mo slurry contained solids with a calculated concentration (also called calculated feed or head grade) of 0.47 wt. % Mo, 24.09 wt. % Cu, and 25.75 wt. % Fe on an elemental and dry basis. The Cu was present mainly as chalcopyrite, and Mo was present mainly as molybdenite. Iron was also present in the Cu—Mo concentrate, typically as iron pyrite and part of the chalcopyrite. The Cu—Mo slurry also contained residual collector agents, frothing agents, and lime.

For Example B1, the flotation procedure for recovering Mo from the Cu—Mo slurry was as follows. Approximately 1,800 grams of the slurry (at about 60 wt. % solids) were placed in a 4 L flotation cell. The Metso Minerals flotation machine was turned on and approximately 40 mL of mine raffinate were added to adjust the pH to 8.5, and the slurry was conditioned for two min at a stir rate of 2100 rpm. Added to the stirred slurry were 1,278 g/ton of Orfom® D8 depressant (38 wt. % disodium carboxymethyltrithiocarbonate; 486 g/ton), 423 g/ton of sodium metabisulfite, and 42 g/ton of Orfom® MCX flotation oil to form a flotation mixture.

The flotation experiments for Examples B1-B5 were performed in substantially the same manner as Examples A1-A3, except after conditioning Examples B1-B5 for 5 min, the volume was adjusted to approximately 33% solids by adding water to a total volume of 4 L, prior to bubbling air into the flotation mixture and collecting the froth as described above.

The same flotation procedure was used for Example B2, except that no Orfom® MCX flotation oil was used, but 2,045 g/ton of Orfom® D8 depressant (38 wt. % disodium carboxymethyltrithiocarbonate; 777 g/ton, dry weight) and 810 g/ton of sodium metabisulfite were used. The same flotation procedure was used for Example B3, except that no sodium metabisulfite was used, but 2,085 g/ton of Orfom® D8 depressant (38 wt. % disodium carboxymethyltrithiocarbonate; 792 g/ton, dry weight) and 41 g/ton of Orfom® MCX flotation oil were used. The same flotation procedure was used for Example B4, except that no sodium metabisulfite and Orfom® MCX flotation oil was used, but 1,985 g/ton of Orfom® D8 depressant (38 wt. % disodium carboxymethyltrithiocarbonate; 754 g/ton, dry weight) were used. The same flotation procedure was used for Example B5, except that mine raffinate was added to adjust the pH to 9.2, and 9944 g/ton (calculated as dry weight) of dilute NaSH was added to achieve a ORP of −469 mV (sodium metabisulfite and Orfom® D8 depressant were not used).

Table II summarizes the percent grade and percent recoveries of Mo, Cu, and Fe for Examples B1-B5. Duplicates of each flotation experiment were conducted, and the average was reported. It should be noted that the data represents only the results obtained from rougher concentrates 1-4 as described above, and does not include the Mo, Cu, and Fe recovered in rougher concentrate 5 (the sample collected after 15 min). The cumulative amount of rougher concentrates 1-4 represents the total amount of molybdenum, copper, and iron, respectively, which were recovered using the flotation process.

As shown in Table II, and unexpectedly, Examples B1 and B2 had percent recoveries of molybdenum of 93.82 wt. % and 92.91 wt. %, respectively, significantly better than that of Examples B3 and B4 (which did not use sodium metabisulfite) at 89.06 wt. % and 90.87 wt. %, respectively. Moreover, Examples B1 and B2 had percent recoveries of molybdenum that were comparable to Example B5, even though Example B5 used a significantly higher collector agent dosage (9944 g/ton of NaSH). Further, Examples B1 and B2 were conducted at a less basic, more neutral pH, than Example B5. Also beneficially, the percent recoveries of copper and iron were less than 2.5-3.5 wt. % for Examples B1 and B2, and superior to the respective percent recoveries in Example B5. Thus, the molybdenum collector compositions used in Example B1 and B2 were successful at selectively removing molybdenum from a Cu—Mo slurry (or concentrate) in which the molybdenum was present at a much lower concentration than copper.

In addition, Examples B1 and B2 had significantly higher Mo grades than Example B5—9.54 wt. % and 15.51 wt. %, respectively, versus 7.83 wt. %—even though Example B5 used a significantly higher collector agent dosage (9944 g/ton of NaSH).

TABLE I

Summary of Molybdenum Concentrate after cumulative 10 minutes flotation-Examples A1-A3

| Example | Molybdenum Collector Composition | Dosage (g/ton) | pH | Grade (wt. %) Mo | Grade (wt. %) Cu | Grade (wt. %) Fe | Recoveries (wt. %) Mo | Recoveries (wt. %) Cu | Recoveries (wt. %) Fe |
|---|---|---|---|---|---|---|---|---|---|
| A1 | Thiocarbonate | 935 | 8.3 | 6.44 | 28.32 | 23.87 | 95.02 | 7.21 | 5.94 |
| | Sodium metabisulfite | 360 | | | | | | | |
| | Orfom ® MCX flotation oil | 31 | | | | | | | |
| A2 | Thiocarbonate | 948 | 8.3 | 6.71 | 25.69 | 23.45 | 88.35 | 5.64 | 4.68 |
| | Orfom ® MCX flotation oil | 31 | | | | | | | |
| A3 | NaSH | 5479 | 10.7 | 7.70 | 24.26 | 25.51 | 96.00 | 6.61 | 6.12 |
| | Orfom ® MCX flotation oil | 28 | | | | | | | |

TABLE II

Summary of Molybdenum Concentrate after cumulative 10 minutes flotation-Examples B1-B5

| Example | Molybdenum Collector Composition | Dosage (g/ton) | pH | Grade (wt. %) Mo | Grade (wt. %) Cu | Grade (wt. %) Fe | Recoveries (wt. %) Mo | Recoveries (wt. %) Cu | Recoveries (wt. %) Fe |
|---|---|---|---|---|---|---|---|---|---|
| B1 | Thiocarbonate | 486 | 8.8 | 9.54 | 17.75 | 16.25 | 93.82 | 3.10 | 2.60 |
| | Sodium metabisulfite | 423 | | | | | | | |
| | Orfom ® MCX flotation oil | 42 | | | | | | | |
| B2 | Thiocarbonate | 777 | 9.0 | 15.51 | 16.35 | 14.77 | 92.91 | 1.93 | 1.76 |
| | Sodium metabisulfite | 810 | | | | | | | |
| B3 | Thiocarbonate | 792 | 9.3 | 12.47 | 15.75 | 14.04 | 89.06 | 1.91 | 1.53 |
| | Orfom ® MCX flotation oil | 41 | | | | | | | |
| B4 | Thiocarbonate | 754 | 9.1 | 12.64 | 18.58 | 16.66 | 90.87 | 2.54 | 2.05 |
| B5 | NaSH | 9944 | 11.5 | 7.83 | 20.38 | 18.25 | 95.61 | 4.85 | 4.07 |

The invention is described above with reference to numerous aspects and specific examples. Many variations will suggest themselves to those skilled in the art in light of the above detailed description. All such obvious variations are within the full intended scope of the appended claims. Other aspects of the invention can include, but are not limited to, the following (aspects are described as "comprising" but, alternatively, can "consist essentially of" or "consist of"):

Aspect 1. A molybdenum collector composition comprising sodium metabisulfite and a thiocarbonate compound.

Aspect 2. The collector composition of aspect 1, wherein the thiocarbonate compound comprises a trithiocarbonate compound.

Aspect 3. The collector composition of aspect 1, wherein the thiocarbonate compound comprises disodium carboxymethyltrithiocarbonate.

Aspect 4. The collector composition of any one of aspects 1-3, wherein the weight ratio of the thiocarbonate compound to sodium metabisulfite is in any suitable range, or any range disclosed herein, e.g., from about 1:10 to about 10:1, from about 1:10 to about 1:1, from about 1:1 to about 10:1, from about 1:5 to about 5:1, from about 1:3 to about 3:1, from about 2:1 to about 4:1, etc.

Aspect 5. The collector composition of any one of aspects 1-4, wherein the collector composition further comprises any suitable collector agent or any collector agent disclosed herein, e.g., a xanthate, a xanthic ester, a xanthogen formate, a dialkyl dithiophosphate, a thionocarbamate, an alkylthiol, an aliphatic or paraffinic hydrocarbon, etc., or any combination thereof.

Aspect 6. A copper-molybdenum concentrate comprising water, copper, and molybdenum.

Aspect 7. The concentrate of aspect 6, wherein the copper-molybdenum concentrate comprises any suitable amount of copper, or any amount of copper disclosed herein, e.g., from about 5 to about 50 wt. %, from about 10 to about 35 wt. %, from about 20 to about 40 wt. %, etc., on an elemental basis, and excluding the weight of water (dry basis).

Aspect 8. The concentrate of aspect 6 or 7, wherein the copper-molybdenum concentrate comprises any suitable amount of molybdenum, or any amount of molybdenum disclosed herein, e.g., from about 0.1 to about 5 wt. %, from about 0.3 to about 3 wt. %, from about 0.4 to about 1 wt. %, etc., on an elemental basis, and excluding the weight of water (dry basis).

Aspect 9. The concentrate of any one of aspects 6-8, wherein the copper-molybdenum concentrate further comprises iron (e.g., iron pyrite) at any suitable amount, or any amount disclosed herein, e.g., from about 5 to about 50 wt. %, from about 10 to about 35 wt. %, from about 20 to about 40 wt. %, etc., on an elemental basis, and excluding the weight of water (dry basis).

Aspect 10. The concentrate of any one of aspects 6-9, wherein the copper-molybdenum concentrate further comprises any suitable frothing agent, or any frothing agent disclosed herein, e.g., MIBC (methyl isobutyl carbinol), pine oil, an alcohol-based frothing agent, etc., or any combination thereof.

Aspect 11. The concentrate of any one of aspects 6-10, wherein the copper-molybdenum concentrate further comprises any suitable collector agent or any collector agent disclosed herein, e.g., a xanthate, a xanthic ester, a xanthogen formate, a dialkyl dithiophosphate, an alkylthiol, a thionocarbamate, an aliphatic or paraffinic hydrocarbon, etc., or any combination thereof.

Aspect 12. The concentrate of any one of aspects 6-11, wherein the copper-molybdenum concentrate is produced by a method comprising contacting a ground ore with a metal collector in a froth flotation process to recover copper and molybdenum.

Aspect 13. The concentrate of aspect 12, wherein the ore comprises a copper-bearing ore.

Aspect 14. The concentrate of aspect 12, wherein the ore comprises a molybdenum-bearing ore.

Aspect 15. The concentrate of aspect 12, wherein the ore comprises chalcopyrite and/or chalcocite.

Aspect 16. A flotation composition comprising:

the molybdenum collector composition of any one of aspects 1-5; and the copper-molybdenum concentrate of any one of aspects 6-15.

Aspect 17. The flotation composition of aspect 16, wherein the weight ratio of the molybdenum collector composition to the copper-molybdenum concentrate is in any suitable range, or any range disclosed herein, e.g., from about 0.05 to about 15 lb, from about 0.5 to about 15 lb, from about 1 to about 25 lb, etc., of molybdenum collector composition per ton of copper-molybdenum concentrate.

Aspect 18. The flotation composition of aspect 16 or 17, wherein the flotation composition has a pH in any suitable range, or any range disclosed herein, e.g., from about 6 to about 12, from about 7 to about 11, from about 7 to about 9, etc.

Aspect 19. A flotation process for the recovery of molybdenum from a copper-molybdenum concentrate, the process comprising contacting the molybdenum collector composition of any one of aspects 1-5 with the copper-molybdenum concentrate of any one of aspects 6-15.

Aspect 20. The process of aspect 19, wherein the molybdenum collector composition and the copper-molybdenum concentrate are contacted at a weight ratio in any suitable range, or any range disclosed herein, e.g., from about 0.05 to about 15 lb, from about 0.5 to about 15 lb, from about 1 to about 25 lb, etc., of molybdenum collector composition per ton of copper-molybdenum concentrate.

Aspect 21. The process of aspect 19 or 20, wherein the molybdenum collector composition and the copper-molybdenum concentrate are contacted at a pH in any suitable range, or any range disclosed herein, e.g., from about 6 to about 12, from about 7 to about 11, from about 7 to about 9, etc.

Aspect 22. The process of any one of aspects 19-21, wherein the percent recovery of molybdenum is at least about 90 wt. %, at least about 91 wt. %, at least about 92 wt. %, at least about 94 wt. %, or at least about 95 wt. %.

Aspect 23. The process of any one of aspects 19-22, wherein the percent recovery of molybdenum is greater (e.g., by at least about 1 wt. %, by at least about 2 wt. %, by at least about 3 wt. %, etc.) than the percent recovery of molybdenum using NaSH instead of the molybdenum collector composition, or within about 2 wt. %, or within about 5 wt. %, of the percent recovery of molybdenum using NaSH instead of the molybdenum collector composition, under the same flotation conditions.

Aspect 24. The process of any one of aspects 19-23, wherein the percent recovery of molybdenum is greater (e.g., by at least about 2 wt. %, by at least about 3 wt. %, by at least about 4 wt. %, etc.) than the percent recovery of molybdenum using the molybdenum collector composition without sodium metabisulfite, under the same flotation conditions.

Aspect 25. The process of any one of aspects 19-24, wherein the percent grade of molybdenum is greater (e.g., by at least about 1 wt. %, by at least about 2 wt. %, by at least about 3 wt. %, etc.) than the percent grade of molybdenum using NaSH instead of the molybdenum collector composition, or within about 2 wt. %, or within about 5 wt. %, of the percent grade of molybdenum using NaSH instead of the molybdenum collector composition, under the same flotation conditions.

Aspect 26. The process of any one of aspects 19-25, wherein the percent grade of molybdenum is greater (e.g., by at least about 1 wt. %, by at least about 2 wt. %, by at least about 3 wt. %, etc.) than the percent grade of molybdenum using the molybdenum collector composition without sodium metabisulfite, or within about 2 wt. %, or within about 5 wt. %, of the percent grade of molybdenum using the molybdenum collector composition without sodium metabisulfite, under the same flotation conditions.

Aspect 27. The process of any one of aspects 19-26, wherein the percent recovery of copper is less than about 15 wt. %, less than about 12 wt. %, less than about 10 wt. %, less than about 8 wt. %, etc.

Aspect 28. The process of any one of aspects 19-27, wherein the percent recovery of copper is less (e.g., by at least about 1 wt. %, by at least about 2 wt. %, by at least about 3 wt. %, etc.) than the percent recovery of copper using NaSH instead of the molybdenum collector composition, or within about 2 wt. %, or within about 5 wt. %, of the percent recovery of copper using NaSH instead of the molybdenum collector composition, under the same flotation conditions.

Aspect 29. The process of any one of aspects 19-28, wherein the percent recovery of copper is less (e.g., by at least about 1 wt. %, by at least about 2 wt. %, by at least about 3 wt. %, etc.) than the percent recovery of copper using the molybdenum collector composition without sodium metabisulfite, or within about 2 wt. %, or within about 5 wt. %, of the percent recovery of copper using the molybdenum collector composition without sodium metabisulfite, under the same flotation conditions.

Aspect 30. The process of any one of aspects 19-29, wherein the percent recovery of iron is less than about 15 wt. %, less than about 10 wt. %, less than about 8 wt. %, less than about 5 wt. %, etc.

Aspect 31. The process of any one of aspects 19-30, wherein the percent recovery of iron is less (e.g., by at least about 1 wt. %, by at least about 2 wt. %, by at least about 3 wt. %, etc.) than the percent recovery of iron using NaSH instead of the molybdenum collector composition, or within about 2 wt. %, or within about 5 wt. %, of the percent recovery of iron using NaSH instead of the molybdenum collector composition, under the same flotation conditions.

Aspect 32. The process of any one of aspects 19-31, wherein the percent recovery of iron is less (e.g., by at least about 1 wt. %, by at least about 2 wt. %, by at least about 3 wt. %, etc.) than the percent recovery of iron using the molybdenum collector composition without sodium metabisulfite, or within about 2 wt. %, or within about 5 wt. %, of the percent recovery of iron using the molybdenum collector composition without sodium metabisulfite, under the same flotation conditions.

What is claimed is:

1. A flotation process for the recovery of molybdenum from a copper-molybdenum concentrate, the process comprising:

contacting a molybdenum collector composition comprising sodium metabisulfite and a thiocarbonate compound; with the copper-molybdenum concentrate, the copper-molybdenum concentrate comprising water, copper, and molybdenum to form a flotation composition; and subjecting the flotation composition to flotation to recover the molybdenum.

2. The process of claim 1, wherein:

a weight ratio of the thiocarbonate compound to sodium metabisulfite in the molybdenum collector composition is in a range from about 1:10 to about 10:1; and the thiocarbonate compound comprises a trithiocarbonate compound.

3. The process of claim 1, wherein:

a weight ratio of the thiocarbonate compound to sodium metabisulfite in the molybdenum collector composition is in a range from about 1:2 to about 6:1; and the thiocarbonate compound comprises disodium carboxymethyltrithiocarbonate.

4. The process of claim 1, wherein the percent recovery of molybdenum from the copper-molybdenum concentrate is at least about 92 wt. %.

5. The process of claim 1, wherein the copper-molybdenum concentrate comprises, on a dry basis:

from about 5 to about 50 wt. % copper; and from about 0.1 to about 5 wt. % molybdenum.

6. The process of claim 5, wherein:

the percent recovery of molybdenum from the copper-molybdenum concentrate is at least about 90 wt. %; and the percent recovery of copper from the copper-molybdenum concentrate is less than about 10 wt. %.

7. The process of claim 6, wherein the copper-molybdenum concentrate further comprises iron.

8. The process of claim 7, wherein:

the copper-molybdenum concentrate comprises from about 20 to about 40 wt. % iron, on a dry basis; and the percent recovery of iron from the copper-molybdenum concentrate is less than about 8 wt. %.

9. The process of claim 1, wherein:

the collector composition further comprises an additional collector agent; and the copper-molybdenum concentrate further comprises a frothing agent.

10. The process of claim 1, wherein the molybdenum collector composition and the copper-molybdenum concentrate are contacted at a weight ratio from about 1 to about 25 lb of the molybdenum collector composition per ton of the copper-molybdenum concentrate, on a dry basis.

11. The process of claim 1, wherein the molybdenum collector composition and the copper-molybdenum concentrate are contacted at a pH in a range from about 7 to about 10.

12. The process of claim 1, wherein process is characterized by a percent recovery of molybdenum from the copper-molybdenum concentrate that is greater than that of a percent recovery using a molybdenum collector composition without sodium metabisulfite, under the same flotation conditions.

13. The process of claim 1, wherein:

the percent recovery of molybdenum from the copper-molybdenum concentrate is at least about 90 wt. %; and the process is characterized by a percent recovery of copper from the copper-molybdenum concentrate that is less than or within about 5 wt. % of a percent recovery of a molybdenum collector composition without sodium metabisulfite, under the same flotation conditions.

14. The process of claim 1, wherein the process is characterized by:

a percent recovery of molybdenum from the copper-molybdenum concentrate that is greater than or within about 2 wt. % of a percent recovery using NaSH instead of the molybdenum collector composition, under the same flotation conditions; and a percent recovery of copper from the copper-molybdenum concentrate that is less than or within about 2 wt. % of a percent recovery using NaSH instead of the molybdenum collector composition, under the same flotation conditions.

15. The process of claim 14, wherein:

the percent recovery of molybdenum from the copper-molybdenum concentrate is at least about 91 wt. %; and the percent recovery of copper from the copper-molybdenum concentrate is less than about 8 wt. %.

16. A molybdenum collector composition comprising sodium metabisulfite and a thiocarbonate compound at a weight ratio of the thiocarbonate compound to sodium metabisulfite in a range from about 1:10 to about 10:1 and the thiocarbonate is a trithiocarbonate.

17. The collector composition of claim 16, wherein:

the weight ratio of the thiocarbonate compound to sodium metabisulfite is in a range from about 1:5 to about 5:1.

18. The collector composition of claim 16, wherein:

the weight ratio of the thiocarbonate compound to sodium metabisulfite is in a range from about 1:2 to about 6:1; and the thiocarbonate compound comprises disodium carboxymethyltrithiocarbonate.

19. A flotation composition comprising:

the molybdenum collector composition of claim 16; and a copper-molybdenum concentrate comprising:

water;

from about 10 to about 35 wt. % copper on a dry basis; and from about 0.3 to about 3 wt. % molybdenum on a dry basis.

20. The flotation composition of claim 19, wherein;

a weight ratio of the molybdenum collector composition to the copper-molybdenum concentrate in the flotation composition is in a range from about 0.5 to about 10 lb of the molybdenum collector composition per ton of the copper-molybdenum concentrate, on a dry basis; and the flotation composition has a pH in a range from about 8 to about 10.

* * * * *